US005657817A

United States Patent [19]

Heine et al.

[11] Patent Number: 5,657,817

[45] Date of Patent: Aug. 19, 1997

[54] ARRANGEMENT FOR CONNECTING TWO OR MORE HEAT EXCHANGES

[75] Inventors: Reinhard Heine, Remseck; Uwe Hoffrogge, Gerlingen; Artur Waesch, Grossbottwar, all of Germany

[73] Assignee: Behr GmbH & Co., Stuttgart, Germany

[21] Appl. No.: 458,650

[22] Filed: Jun. 2, 1995

[30] Foreign Application Priority Data

Jul. 18, 1994 [DE] Germany ..... 44 25 350.8

[51] Int. Cl.[6] ..... F28F 9/00

[52] U.S. Cl. ..... 165/67; 165/140; 180/68.4; 248/222.11

[58] Field of Search ..... 165/67, 140; 180/68.4; 248/222.11, 222.12

[56] References Cited

U.S. PATENT DOCUMENTS

| | | | |
|---|---|---|---|
| 4,541,645 | 9/1985 | Foeldesi | 180/68.4 |
| 4,997,033 | 3/1991 | Ghiani et al. | 165/67 |
| 5,113,930 | 5/1992 | le Gauyer | 165/78 |
| 5,139,080 | 8/1992 | Bolton et al. | 165/67 |
| 5,163,505 | 11/1992 | Hoffman et al. | 165/67 |
| 5,219,016 | 6/1993 | Bolton et al. | 165/67 X |
| 5,348,268 | 9/1994 | Klein | 248/222.11 X |
| 5,417,395 | 5/1995 | Fowler et al. | 248/222.11 |

FOREIGN PATENT DOCUMENTS

| | | | |
|---|---|---|---|
| 0346602 | 12/1989 | European Pat. Off. . | |
| 0519615 | 12/1992 | European Pat. Off. . | |
| 3428857 | 2/1986 | Germany . | |
| 3536457 | 6/1987 | Germany . | |
| 3820623 | 12/1989 | Germany . | |
| 2150685 | 7/1985 | United Kingdom | 165/67 |

*Primary Examiner*—Leonard R. Leo

*Attorney, Agent, or Firm*—Evenson McKeown Edwards & Lenahan, PLLC

[57] ABSTRACT

One of two heat exchangers to be joined is provided with pins which project to one side and the other heat exchanger is provided with openings assigned to these pins in such a manner that the pins can act as a hinge so that, after a defined swivelling, the two heat exchangers can be secured in the mounting position by means of snap brackets.

15 Claims, 4 Drawing Sheets

1
17
XI
18
2
VI
IV
11
9
3
10
12
5
VII
13
III
7
8
4
6
X
II
V
20(19)

ARRANGEMENT FOR CONNECTING TWO OR MORE HEAT EXCHANGES

BACKGROUND AND SUMMARY OF THE INVENTION

This invention relates to an arrangement for connecting two or more heat exchangers with one another which are each equipped with collecting tanks, particularly made of plastic, and with flow paths with heat exchange surfaces for a heat exchange medium extending between these collecting tanks.

In practice, particularly in vehicle construction, it is often necessary to join several heat exchangers in order to, for example, in the case of a commercial vehicle, connect a charge air cooler with the radiator for the engine coolant. The mounting of such heat exchangers may result in high expenditures when, for example, in the case of narrow space conditions in the engine compartments of motor vehicles, one cooler or radiator is to be mounted to the cooler or radiator already situated in the vehicle.

Since the connections of the cooler and the radiator are to be designed such that they compensate the different heat expansions of the radiator and the cooler and must also absorb manufacturing tolerances, special holding devices and screwed connections have been provided so that the forces occurring as a result of the acceleration of the masses in the vehicle operation can be absorbed in a perfect manner. The mounting operation by means of such screwed connections results in high expenditures.

It is an object of the invention to provide an arrangement of the initially mentioned type by means of which two or several heat exchangers can be fixedly connected with one another in a simple manner without the occurrence of problems caused by different heat expansions of the two heat exchangers or by tolerance-caused dimensional deviations.

According to the invention, this object is achieved in that pins, which project at a distance from one another and approximately perpendicularly from its longitudinal direction, are assigned to one of the collecting tanks of a heat exchanger. These pins can be introduced into corresponding openings in shackle-type abutments on the assigned collecting tank of the other heat exchanger, and can be positioned in a defined end position by a swivelling about an abutment surface. Locking devices, particularly snap hooks, for securing the end position of the pins and of the two heat exchangers are assigned to the other two collecting tanks. By means of this development, high-expenditure connection elements, such as screws, holding devices, or the like, become superfluous. One heat exchanger can be prepositioned on the other heat exchanger by the introduction of its pins and, by means of the folding in against the other heat exchanger, can be brought into its end position and can be locked there.

It is true that it is known from European Patent Document EP 0 346 601 B1, for the purpose of fastening the lateral parts of a radiator for vehicle engines, to cause pins to engage in recesses of the lateral parts, which pins are fastened on the collecting tanks and act in the manner of hinges in order to permit a hinging of the lateral parts on the collecting tanks for the purpose of mounting. In the case of the arrangement of lateral parts, the mutual alignment of two heat exchangers which may also be subjected to different heat expansions is not important. There also, the swivelled-in position of the lateral parts is secured by wedges which must be pushed in separately. The device illustrated there has nothing in common with the connection of two or more heat exchangers.

In a further development of the idea of the invention, two snap brackets may be provided as a locking device which can each be swivelled elastically about an axis, which are each approximately assigned to the end area of a collecting tank and which are aligned perpendicularly with respect to one another by means of their swivel axes. In a further development of the invention, the cross-sections of at least one of the pins and of the opening of the abutment assigned to it may be adapted to one another in the longitudinal direction of the collecting tanks so that, after the pins were introduced into the assigned openings and during the swivelling, a precise alignment can also take place of the two water boxes in the direction of the longitudinal axis of their collecting tanks. This may be promoted by the fact that one of the pins has a rectangular cross-section but the other one has a square cross-section with two lateral walls which are aligned in parallel with respect to one another and in the case of which at least one additional lateral wall extends diagonally with respect to the wall opposite from it and, in its slope, corresponds to the slope of the wall of the abutment interacting with it during the positioning of the heat exchanger. By means of this development, one of the pins receives, on at least one side, a wedge-type construction which has the result that an alignment occurs in one direction during the swivel operation without the requirement of taking special measures for such an alignment. Since the sloping takes place only in one direction and on one lateral wall, it is nevertheless still possible for the pins to shift perpendicularly with respect to the longitudinal axes of the collecting tanks, should heat expansions occur.

In a further development of the invention, one of the snap brackets may be aligned horizontally and the other may be aligned perpendicularly, in which case one contact surface for a stop of a heat exchanger and one opposite surface as an engaging edge as well as elastic rib will then be assigned to each snap bracket which are assigned to the engaging edge in such a manner that its free end is situated in the moving path of the end of the snap bracket provided with the detent hook and, when the snap bracket is engaged, presses against the side of the end of the snap brackets which faces away from the detent hooks. On the one hand, because of the perpendicular arrangement of the snap brackets with respect to one another, this development ensures that also a parallelogram shape caused by manufacturing can be compensated; that is, a shape of the heat exchangers which deviates from a precise rectangle and which may in fact occur in practice as a result of manufacturing. The perpendicular snap bracket is arranged close to a fixed-bearing point and may carry out its function also in the case of angular deviations of the bottom.

Since, in the area of the horizontally arranged snap bracket, a sloped position of the bottom must also be expected, it is advantageous for the support surface of the horizontally aligned snap bracket to have a slightly elastic construction.

Other objects, advantages and novel features of the present invention will become apparent from the following detailed description of the invention when considered in conjunction with the accompanying drawings.

DETAILED DESCRIPTION OF THE DRAWINGS

Figures 1, 2, 3:
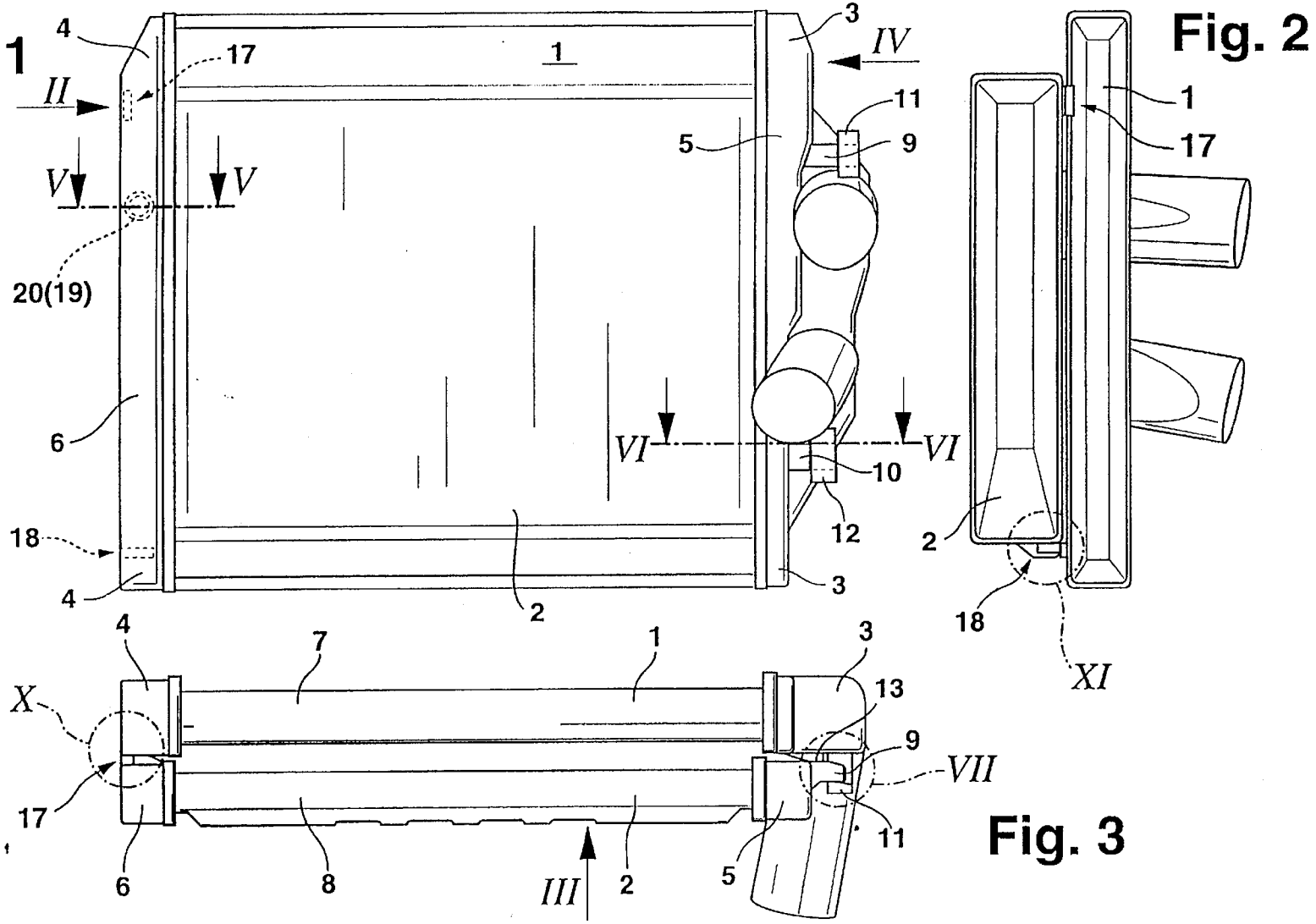
FIG. 1 is a schematic representation of a frontal view of an arrangement according to the invention for connecting a charge air cooler and a coolant radiator.
FIG. 2 is a lateral view of the arrangement of FIG. 1 taken in the direction of arrow II of FIG. 1.
FIG. 3 is a top view of the arrangement of FIG. 1 viewed in the direction of the arrow III of FIG. 1.
Figure 4:
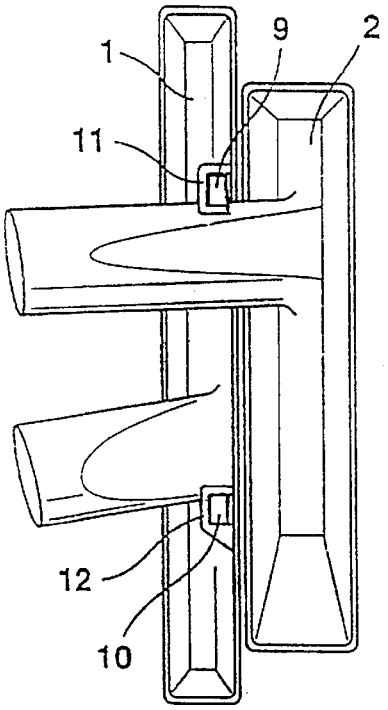
FIG. 4 is a lateral view of the arrangement of FIG. 1 viewed in the direction of the arrow IV.

FIGS. 1 to 3 illustrate an arrangement comprising a charge air cooler 1 and a coolant radiator 2 which are both fixedly connected with one another. The charge air cooler 1 as well as the coolant radiator, which is used for cooling the engine coolant of an internal combustion engine for a vehicle which is not shown, are each equipped with collecting tanks 3, 4 and 5, 6 between which, in a manner not shown in detail because it is known, so-called ribbed tube blocks 7 and 8 extend which are used as heat exchange surfaces for the heat exchange medium flowing in each case between the collecting tanks 3, 4, on the one hand, and 5, 6, on the other hand. In the shown embodiment, the coolant radiator 2 is fastened to the charge air cooler 1 by the fact that two pins 9 and 10, which project from the collecting tank 5 approximately perpendicularly with respect to the longitudinal direction of the collecting tank 5 of the coolant radiator 2, engage in corresponding openings in abutments 11 and 12 which are constructed in the manner of shackles and which are in each case mounted on the side of the collecting tanks 3 pointing to the coolant radiator 2. In this case, the pins 9 and 10 rest against the abutment 11 and 12 as well as against the stop surfaces 13 and 14 which are also mounted on the collecting tank 3.

Figure 6:
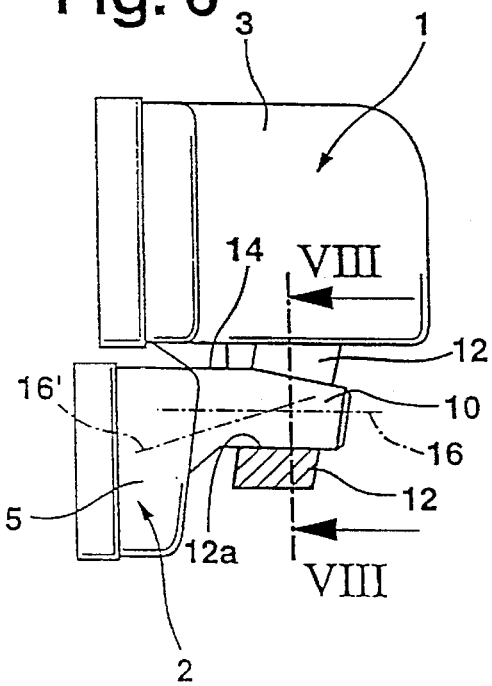
FIG. 6 is an enlarged representation of a detail of a sectional view taken along Line VI—VI in FIG. 1.
Figure 7:
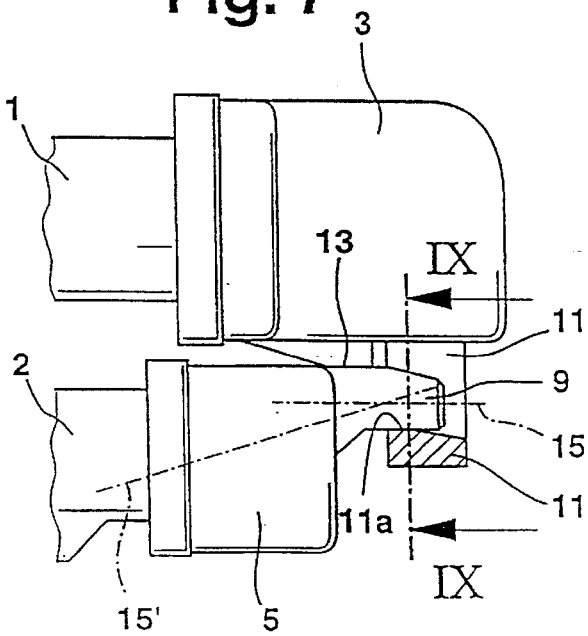
FIG. 7 is an enlarged representation of the detail VII in FIG. 3.

As illustrated in the enlarged representations of FIGS. 6 and 7, the pin 9 of the collecting tank 5, in this case, rests by means of its side pointing away from the collecting tank 3 against the interior surface of the abutment 11 and rests by means of a side facing the collecting tank 3 against the stop surface 13 if, as indicated in FIGS. 6, 7 or 3, it is in its fastening position.

FIGS. 6 and 7 also show that the stop surfaces 13 and 14 are each arranged in an offset manner with respect to the abutment surfaces 11*a* and 12*a* of the shackle-type abutments 11 and 12. This offset arrangement makes it possible that, during the mounting, the pins 9 and 10, with respect to the representation of FIGS. 6 and 7, each swivelled counterclockwise about a defined angle, can be pushed into the openings, which are constructed to be larger in their dimensions than the cross-section of the pins 9 and 10, between the stop surfaces 13, 14 and the respective left edge of the abutment surfaces 11*a* and 12*a*, before a swivel operation takes place clockwise for the purpose of the mounting. The coolant radiator 2 is therefore connected with the charge air cooler 1 which is, for example, already fixedly arranged in the engine compartment of a vehicle in that it is set slightly diagonally with respect to the charge air cooler 1, approximately such that the longitudinal axes 15, 16 each indicated in FIGS. 6 and 7 each take up position 15' or 16'. The coolant radiator 2 will then be swivelled clockwise until the mounting position illustrated in FIGS. 6, 7 and 3 is reached. The pins 9 and 10 are then held fixedly and securely because of their two-sided contact.

Figure 8:
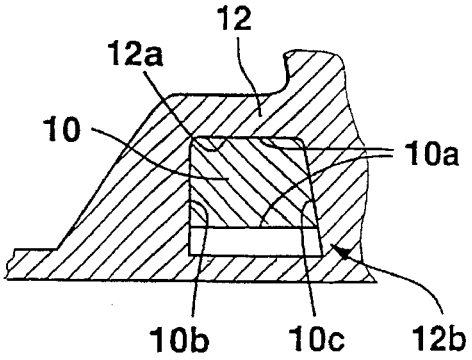
FIG. 8 is the schematic representation of the sectional view VIII—VIII of the pin connection of FIG. 6.
Figure 9:
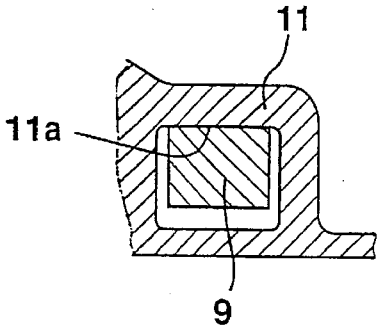
FIG. 9 is a schematic representation of the sectional view according to Line IX—IX in FIG. 7.

FIGS. 8 and 9 also show that the upper pin 9 is guided with a lateral play inside its shackle-type abutment 11. The pin 9 therefore forms a type of movable bearing with the abutment 11 which makes it possible that length changes of the heat exchangers can be absorbed in the direction of their collecting tanks. Length changes in the direction of the tubes of the ribbed tube blocks which are not shown in detail, that is, length changes transversely with respect to the collecting tanks 3 and 5, can be absorbed by the longitudinal displaceability of the pins 9 and 10 in their position between the stop surfaces 13 and 14 and the abutment surfaces 11*a* and 12*a*.

However, in order to obtain a clear assignment of the mounting position of the coolant radiator 2 with respect to the charge air cooler 1, the pin 10, as illustrated in FIG. 8, is provided with a cross-section in the shape of a trapezoid with two lateral walls 10*a* extending in parallel to one another and one lateral wall 10*b* which stands perpendicularly with respect thereto. The fourth lateral wall 10*c* is sloped diagonally with respect to the lateral wall 10*b* and a correspondingly diagonally sloped interior wall 12*b* of the bow-type abutment 12 is assigned to the fourth lateral wall 10*c*. When the coolant radiator 2 is swivelled clockwise for the purpose of the fastening, in the representation according to FIG. 8, the pin 10 is therefore pressed from below in a wedge shape into the recess inside the abutment 12 which is adapted to its cross-sectional shape. The pin 10 therefore forms a fixed bearing with its abutment which fixed bearing results in a secure anchoring of the two heat exchangers on one another. Naturally, it would also be possible to achieve the corresponding wedge shape according to other contemplated embodiments when both lateral walls 10*c* and 10*b* are arranged diagonally with respect to the parallel lateral walls 10*a* and the assigned interior walls 12*b* of the abutment 12 are both adapted to the slope of these lateral walls.

Figure 5:
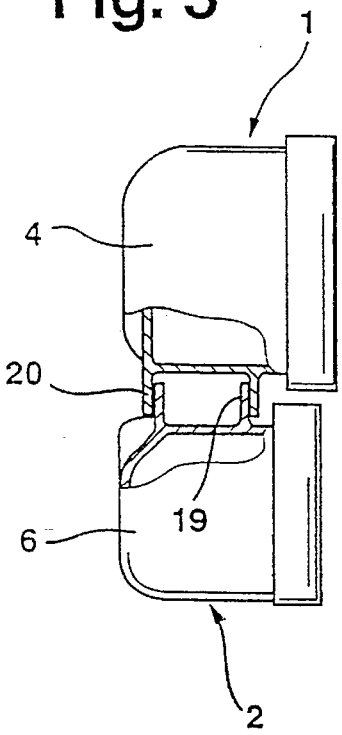
FIG. 5 is the representation of a partial sectional view of the left collecting tanks of FIG. 1, taken along line V—V.

The securing of the mounting position achieved by the clockwise swivel motion in the embodiment shown is in each case achieved by snap brackets 17 and 18 whose development is shown in detail in FIGS. 10 and 11 and will be explained in the following. However, in addition to these snap brackets 17 and 18, another force absorption point is also assigned to the collecting tanks 4 and 6 which has the purpose of causing a form-locking securing of the position. For this purpose, a hollow pin 19 (FIG. 5) is assigned to the collecting tank 6 of the coolant radiator 2 which projects to one side and which is inserted in a fitting manner into a hollow pin 20 projecting away from the collecting tank 4.

Figure 10:
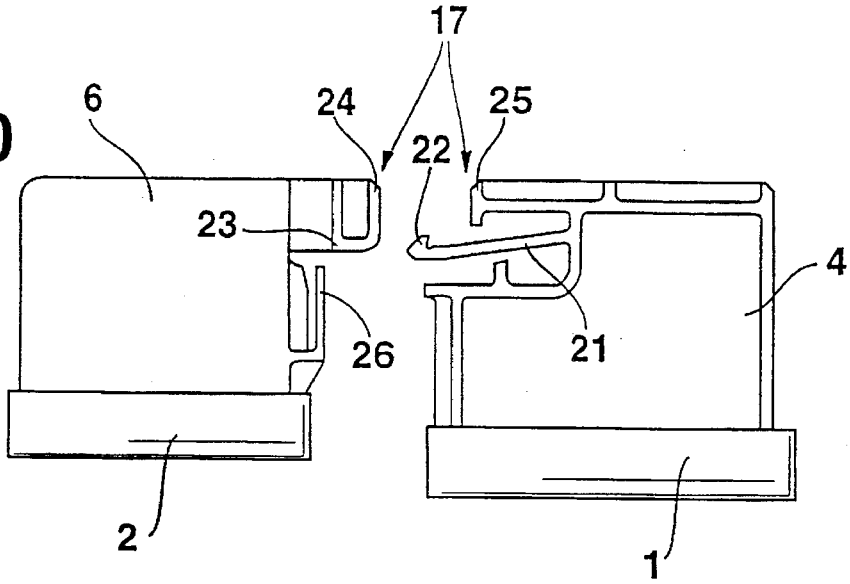
FIG. 10 is the enlarged representation of the snap bracket connection show on the left top in FIG. 1 in the unmounted position.
Figure 10A:
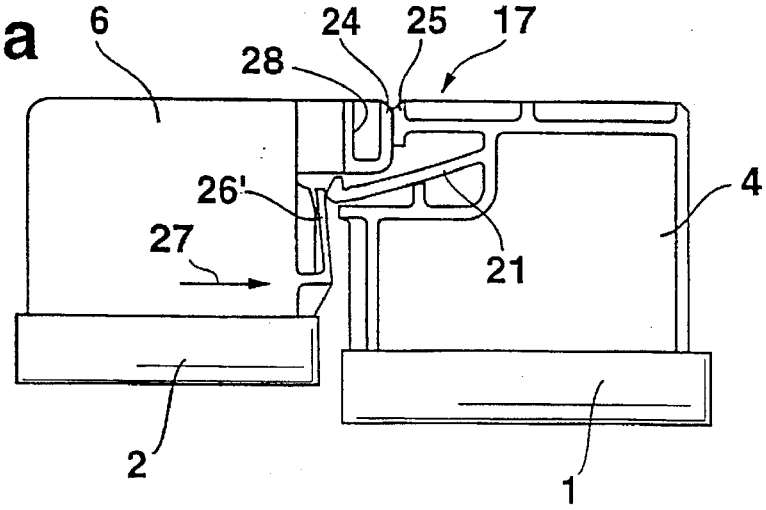
FIG. 10*a* is the enlarged representation of the snap bracket connection of FIG. 10 during the connecting operation.
Figure 11:
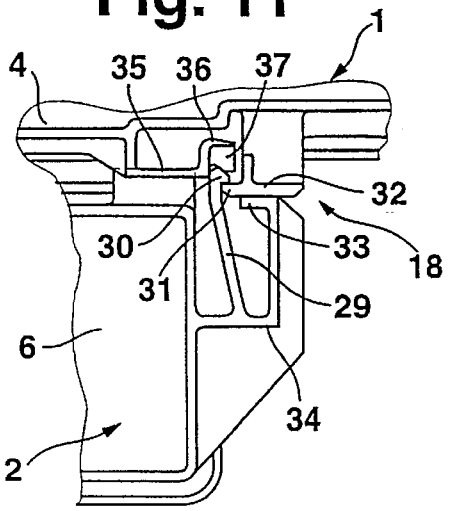
FIG. 11 is an enlargement representation of the detail XI in FIG. 2 with the lower snap bracket connection of the arrangement in FIG. 1 in the locked condition.

FIGS. 10 and 10*a* first show that, at the point which is shown on the left top in FIG. 1, a snap bracket arrangement 17 is assigned to the collecting tank 6 of the coolant radiator 2, which snap bracket arrangement 17 comprises a snap bracket 21 which is elastically mounted on a part of the collecting tank 4 of the charge air cooler 1 and has a hook 22 on its end, and a detent edge 23 which is assigned to this snap bracket 21 or to its hook 22 and to which a contact surface 24 is assigned in the embodiment shown for an interaction with an opposite surface 25 on the collecting tank 4. 0n the collecting tank 6, an elastic securing web 26 is also arranged which, in the mounted condition, has the task of securing the snap bracket 21 in the achieved end position. This is better illustrated in FIG. 10*a* where the last phase of the mounting operation is shown. When the coolant radiator 2 is swivelled clockwise, the free end of the snap bracket 21 with the detent hook 22 strikes against the securing web 26 and presses it first into position 26' until, by a further pressing of the coolant radiator 2 in the direction of the arrow 27 after a defined elastic deformation of the contact surface 24, the detent hook 22 engages behind its detent edge 23. When this has happened, the securing web becomes free and, because of its elasticity, moves back into position 26. It will then press by means of its free end from the outside against the detent hook 22 and will prevent an unintentional release of this hook from the mounting position.

It may be mentioned here that the collecting tanks 3, 4, 5 and 6 of the charge air cooler and of the coolant radiator 2 are made of plastic and that all parts described up to now, including the snap bracket 21 or the pins 9 and 10, are also made of plastic. The development of the contact surface 24 as a leg on an otherwise U-shaped rib 28 therefore ensures the elasticity required for the mounting. It also has the advantage that certain manufacturing tolerances can be compensated because in each case the two heat exchangers can be pressed against one another to such an extent that the snap bracket 21 will engage.

As described above, snap bracket arrangement 17 is arranged vertically. In contrast, snap bracket arrangement 18 is arranged horizontally. This development also permits a joining of the two heat exchangers even when their exterior shape is not exactly rectangular as a result of manufacturing but, which is customary, has the approximate shape of a parallelogram. This horizontal detent arrangement also consists of a snap bracket 29 with a hook 30 which is mounted on the collecting tank 6 of the coolant radiator 2, and of a detent edge 31 and a contact surface 32 which are assigned to the collecting tank 4 of the charge air cooler 1. An opposite surface 33 of the collecting tank 6, in turn, interacts with the contact surface 32, which opposite surface 33 is mounted on an angular projection 34 from which the snap bracket 29 also projects.

According to FIG. 11, a securing web 35 is assigned to the snap bracket 29 and has a contact edge for securing the detent position of the snap bracket 29 but also an actuating web 36 whose function will be explained by means of FIGS. 11*a* to 11*c*. A rib 37 which projects from the actuating web 36 is assigned to this actuating web 36 and has a recess 38 in which there is sufficient room for the head of the hook 30 when the snap bracket is engaged.

Figure 11A:
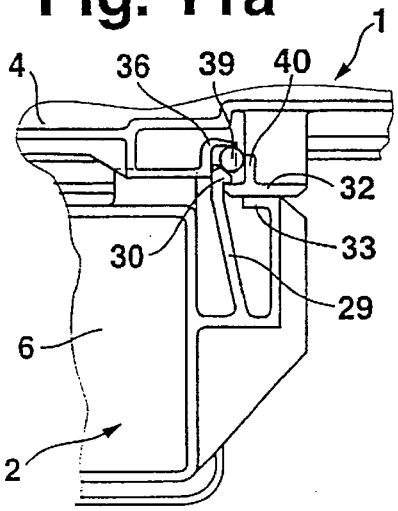
FIG. 11*a* is a view of the snap bracket connection of FIG. 11 during a first step for canceling the snap locking.
Figure 11B:
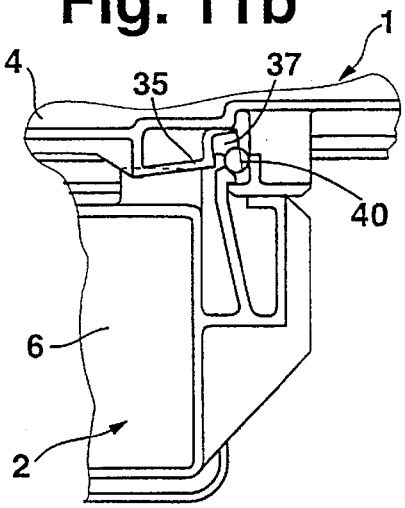
FIG. 11*b* is a representation similar to FIG. 11*a* but in another releasing phase.
Figure 11C:
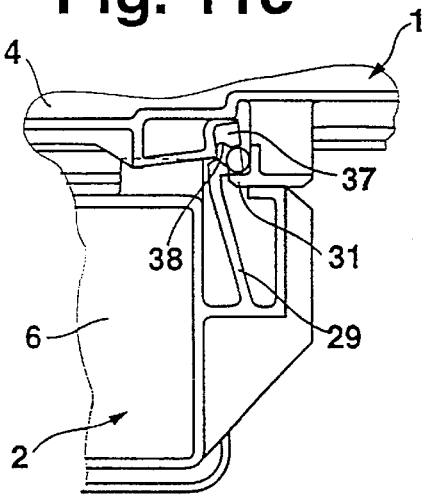
FIG. 11*c* is a view of the demounting phase which follows the phase of FIG. 11*b* and in which the hook of the snap bracket is released from its opposite surface.
Figure 11D:
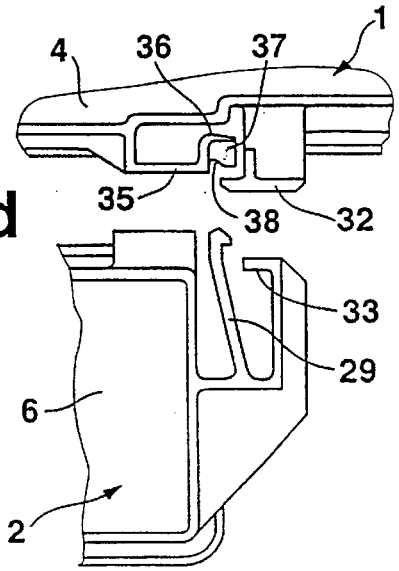
FIG. 11*d* is a view of the snap bracket arrangement of FIG. 11 but in the detached condition.

FIG. 11*a* first shows that, for the demounting on the poorly accessible point of the snap bracket 18 on the bottom side of the two heat exchangers, a tool 39 is provided, approximately in the shape of a screwdriver, which can be introduced from the side into the space between the hook 30 and an upwardly projecting rib 40 of the support 32.

According to FIG. 11*b*, by means of the further introduction of this tool, the wall 37 can be gripped from below and, according to FIG. 11*c*, can be pressed upward so that the recess 38 and its securing edge of the securing web 35 is lifted off so far upwards that the hook of the snap bracket 29 is released from its detent edge 31 and the coolant radiator 2 can be swivelled away from the charge air cooler 1, specifically now in a counterclockwise manner until the pins 9 and 10 also take up again the diagonal position with respect to their contact surfaces 11*a* and 13 mentioned above with respect to the mounting, and in this manner the coolant radiator can then be detached from the charge air cooler. Naturally, it is also required before the demounting operation to release the upper snap bracket 17 before the radiator and the cooler can be separated.

By means of the development according to the invention, it becomes possible in a very simple manner without the aid of screwing tools or the like to establish a secure and durable connection between two heat exchangers. Naturally, it would also be conceivable to fasten an additional third heat exchanger, for example, an oil cooler, in a similar manner if the requirement existed. By means of the development of the pin bearing (of pins 9 and 10), on the one hand, and of the arrangement of the snap brackets (which stand on one another in a vertical manner), on the other hand, in addition to the simple handling, reliability is also provided for an exact alignment of the heat exchangers which are fastened to one another. There is also the possibility of compensating manufacturing tolerances as well as the possibility that the new connection absorbs heat expansions. The development according to the invention is particularly suitable for heat exchangers with collecting tanks made of plastic because the above-mentioned parts can then be manufactured in a simple manner in one piece with the collecting tanks.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A connecting arrangement for connecting first and second heat exchangers with one another, which heat exchangers are each equipped with collecting tanks, and with flow paths with heat exchange surfaces for a heat exchange medium extending between the collecting tanks, said connecting arrangement comprising:

pins assigned to the collecting tank of a first heat exchanger, said pins being arranged at a distance from one another and projecting approximately perpendicularly with respect to a longitudinal direction of the collecting tanks, shackle-type abutments assigned to a collecting tank of the second heat exchanger, said abutments being configured to receive respective ones of said pins at respective abutment surfaces to arrange first and second heat exchangers in a defined end position, and locking devices including snap hooks for securing the first and second heat exchangers in the end position of the two heat exchangers.

2. Arrangement according to claim 1, wherein the locking devices include two snap bracket arrangements which can each be elastically swivelled about an axis, which are each assigned approximately to an end area of a collecting tank and are aligned perpendicularly with one another by means of their swivel axes.

3. Arrangement according to claim 2, wherein one snap bracket arrangement is arranged horizontally and the other snap bracket arrangement is arranged vertically.

4. Arrangement according to claim 3, wherein each of the snap bracket arrangements has a snap bracket to which a contact surface is assigned for a stop as well as an opposite surface as an engaging edge and an elastic securing edge, which is assigned to the engaging edge in such a manner that its free end is situated in the moving path of the end of the snap bracket provided with the detent hook and, when the snap bracket is engaged, presses against the side of the end of the snap bracket which faces away from the detent hook.

5. Arrangement according to claim 4, wherein the contact surface of the horizontally aligned snap bracket arrangement has a slightly elastic construction.

6. Arrangement according to claim 2, wherein at least one additional force absorption point in the form of a pin which engages in a recess of the collecting tank and is arranged on the other collecting tank is assigned to the collecting tanks equipped with the snap bracket arrangements.

7. An arrangement according to claim 2, wherein said locking devices are located at the collecting tank of the second heat exchanger.

8. Arrangement according to claim 1, wherein the cross-sections of at least one of the pins and of the opening assigned thereto of the abutment are adapted to one another in the longitudinal direction of the collecting tanks.

9. Arrangement according to claim 8, wherein said locking devices are located at the collecting tank of the second heat exchanger.

10. Arrangement according to claim 1, wherein one of the two pins is provided with a rectangular cross-section but the other pin is provided with a cross-section with two lateral walls assigned in parallel with respect to one another, at least one additional lateral wall extending diagonally to the parallel lateral walls and in its slope corresponding to the slope of the wall of the abutment interacting with it during the positioning of the heat exchanger.

11. Arrangement according to claim 10, wherein said locking devices are located at the collecting tank of the second heat exchanger.

12. Arrangement according to claim 1, wherein a stop surface is assigned to each abutment surface of the pins the respective pin resting in its end position on a respective one of said stop surfaces.

13. Arrangement according to claim 12, wherein the stop surfaces are arranged offset with respect to the abutment surfaces.

14. Arrangement according to claim 13, wherein said locking devices are located at the collecting tank of the second heat exchanger.

15. An arrangement according to claim 1, wherein said locking devices are located at the collecting tank of the second heat exchanger.

* * * * *